US006048404A

United States Patent [19]

White

[11] Patent Number: 6,048,404

[45] Date of Patent: Apr. 11, 2000

[54] TOBACCO FLAVORING COMPONENTS OF ENHANCED AROMATIC CONTENT AND METHOD OF PROVIDING SAME

[75] Inventor: Jackie Lee White, Pfafftown, N.C.

[73] Assignee: R.J. Reynolds Tobacco Company, Winston-Salem, N.C.

[21] Appl. No.: 09/074,271

[22] Filed: May 7, 1998

[51] Int. Cl.[7] ..... A24B 15/30

[52] U.S. Cl. ..... 131/275; 131/274; 131/290; 131/297; 131/299

[58] Field of Search ..... 131/274, 275, 131/290, 297, 299; 426/466, 468

[56] References Cited

U.S. PATENT DOCUMENTS

| | | | |
|---|---|---|---|
| 3,478,015 | 11/1969 | Onishi et al. . | |
| 4,150,677 | 4/1979 | Osborne, Jr. et al. | 131/275 |
| 4,306,577 | 12/1981 | Wu et al. | 131/275 |
| 4,537,204 | 8/1985 | Gaisch et al. | 131/274 |
| 5,103,843 | 4/1992 | Burger et al. | 131/275 |
| 5,413,122 | 5/1995 | Shu et al. | 131/274 |

FOREIGN PATENT DOCUMENTS

| | | |
|---|---|---|
| 572236 | 9/1945 | Germany . |
| 1 517 280 | 9/1969 | Germany . |

*Primary Examiner*—Stanley S. Silverman
*Assistant Examiner*—Michael P. Colaianni

[57] ABSTRACT

Improved flavorful and aromatic tobacco materials and processes for producing flavorful and aromatic components from tobacco material are provided. The processes involve subjecting substantially dry liquid free tobacco material directly to heat treatment in an enclosed pressure controlled environment at a temperature for a period of time such that flavorful and/or aromatic substances are provided while excess weight loss in the tobacco material is avoided.

21 Claims, 4 Drawing Sheets

TOBACCO FLAVORING COMPONENTS OF ENHANCED AROMATIC CONTENT AND METHOD OF PROVIDING SAME

FIELD OF THE INVENTION

The present invention relates to flavor and aroma substances, i.e. flavor additives, for tobacco materials, cigarettes and other smoking articles and to methods for manufacturing these materials.

BACKGROUND OF THE INVENTION

Popular smoking articles, such as cigarettes, have a substantially cylindrical rod shaped structure and include a charge of smokable material, such as shreds or strands of tobacco material (i.e., in cut filler form), surrounded by a paper wrapper, thereby forming a tobacco rod. It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material. Many cigarettes include processed tobacco materials and/or tobacco extracts in order to provide certain flavorful characteristics to those cigarettes.

Many types of smoking products and improved smoking articles have been proposed through the years as improvements upon, or as alternatives to, the popular smoking articles. Recently, U.S. Pat. Nos. 4,708,151 to Shelar; 4,771,795 to White et al; 4,714,082 to Banerjee et al; 4,756,318 to Clearman et al; and 4,793,365 to Sensabaugh, Jr. et al; and European Patent Publication Nos. 212,234 and 277,519 propose cigarettes and pipes which comprise a fuel element, an aerosol generating means physically separate from the fuel element, and a separate mouth end piece. Such types of smoking articles provide natural tobacco flavors to the smoker thereof by heating, rather than burning, tobacco in various forms. Generally, natural tobacco flavors and aromas are important for the taste, aroma, and acceptance of smoking products, including substitute smoking materials. Thus, the search for natural tobacco flavor additives or flavor substances is a continuing task.

For example, U.S. Pat. No. 3,424,171 describes a process for the production of a non-tobacco smokable product having a tobacco taste. Tobacco is subjected to a moderate (i.e. below scorching) heat treatment i.e., at from about 175° to 200° C. (350° to 400° F.), to drive off aromatic components. These components are trapped on adsorbent charcoal, and removed from the charcoal by solvent extraction. The smokable product disclosed is vegetable matter, treated with the mixture of tobacco aromatic components and the solvent.

Similarly, U.S. Pat. No. 4,150,677 describes a process for the treatment of tobacco which comprises the steps of: (1) contacting tobacco which contains relatively high quantities of desirable flavorants with a stream of non-reactive gas, under conditions whereby the tobacco is heated in a temperature range from about 140° to 180° C.; (2) condensing the volatile constituents of the resulting gaseous stream; and (3) collecting said condensate. The condensate may be used subsequently to flavor a smoking material in order to enhance the organoleptic qualities of its smoke.

British Patent No. 1,383,029 describes a method of obtaining tobacco aroma substances which comprises an extraction treatment wherein the components of the tobacco that are soluble in a suitable solvent are extracted and the residue is obtained after removing the solvent is subjected to heat treatment at a temperature from 30° to 260° C.

U.S. Pat. Nos. 5,038,802 to White et al. and 5,016,654 to Bernasek et al. disclose extraction processes which heat tobacco and then pass an inert atmosphere through the heating chamber to collect volatiles from the tobacco. The volatiles are then fractionated in downstream operations, which include liquid sorbents, cold temperature traps, and filters.

U.S. Pat. No. 5,235,992 to Sensabaugh proposes a process that involves heating tobacco (e.g., in a flowing gas stream) during a first staged heating to a first "toasting" temperature to drive off volatile materials, increasing the toasting temperature during a second staged heating, and separately collecting, as flavor substances, at least portions of the volatile materials driven off at the first and second toasting temperatures.

U.S. Pat. No. 5,121,757 to White et al. proposes a process for altering the chemical nature of a tobacco extract, in which tobacco material is extracted with a chemical solvent, the extract is contacted with an ammonia compound, and the ammonia-treated extract is subjected to heat treatment in a pressure-controlled environment (e.g., in a Parr bomb).

While these processes have produced flavor substances acceptable for use in many smoking articles, they have either not been suitable for some smoking articles, or have necessarily required the forming of a tobacco extract prior to the obtaining of the desired compound, or have required expensive or inabundant starting materials. Moreover, many of these processes required multiple steps of processing. These multiple steps can not only lead to increased cost but also result in significant loss of the flavorful and aroma compounds. Thus, there is need to provide efficient and effective processes for producing flavorful and aromatic components useful in the manufacture of smoking articles.

SUMMARY OF THE INVENTION

The present invention generally relates to natural tobacco flavoring components useful in tobacco smoking products, and in tobacco substitute materials as a source of tobacco smoke flavor and/or aroma and to processes for the production of these components. The flavorful and aromatic smoking components of the present invention are prepared from readily available tobacco materials, preferably tobacco dust from the cigarette manufacturing process which is normally discarded as waste, without requiring complicated extraction procedures and similar liquid processing steps. Various sources of tobacco can be used to provide the flavorful smoking components in accord with the invention, although tobacco dust is preferred.

The process of this invention produces a substantially dry material having a complex mixture of volatile, semi-volatile, and non-volatile aroma/flavor components that are products of the Maillard reactions. The resultant material can be used directly in the manufacture of conventional cigarettes or other smoking articles without the need of any further processing. The flavorful and aromatic substances produced by the invention described herein provide aromatic components, as evidenced by total volatile profiles and individual volatile component, in quantities greatly exceeding the useful aromatic content of comparable prior art materials.

In accord with the invention, tobacco material in substantially dry form, preferably 15 wt% moisture or less, is directly subjected to heat treatment in closed, elevated pressure environment (e.g., a Parr bomb) for a time sufficient to alter the organoleptic characteristics (e.g., the flavor and aroma characteristics) of the tobacco material. Normally, the tobacco material is exposed to a temperature sufficiently high and for a period of time sufficiently long so as to provide a substantial increase in aroma/flavor compounds. In accord with the invention, it has been found that heat treatment of substantially dry tobacco in a high pressure, closed environment, provides a tobacco flavoring material having greatly increased quantities of flavor and aroma components as compared to conventional heat treated tobacco. Although not wishing to be bound by theory, it is believed that the heat treated tobacco flavoring material of the invention retains aromatic flavor components generated by the heat treatment, which are apparently lost during conventional heat treating processes. In addition, because the process of the invention does not add substantial moisture or other materials to the tobacco, the final product is a storage stable material that does not require refrigeration to prevent the growth of mold or to prevent bacteria fermentation. Moreover, because the products of the invention can be employed as components in smoking articles such as cigarettes and the like, without a need for drying or other processing steps that involve heating, the volatile flavor components of these products are not lost during processing and remain available to enhance the flavor and aroma of the final smoking articles.

In general, it is preferable that the process of the invention is carried out so that the tobacco material is not exposed to such a high temperature for such a long period of time so as to provide an aroma/flavor which exhibits a burnt or tarry aroma/flavor. Thus, for the purposes of this invention, it is convenient to refer to the heat treatment, or the moderately high temperature treatment, of a tobacco material. For the purposes of the invention, the tobacco material to be treated can be in the form of cigarette dust, powder, shreds, or tobacco stems or leaves. If desired, additives (e.g., amino acids, amino acid analogs or amino acid sources or other nitrogen sources, and/or sugar or sugar sources) may be added to the tobacco material prior to heat treatment.

Accordingly, the present invention more particularly relates to a process of producing a natural tobacco flavor or aroma component by subjecting substantially dry tobacco material directly to heat treatment at a temperature between about 100° C. and 250° C., more preferably between about 100° C. and about 200° C., in an elevated pressure, closed environment. In general, the pressure experienced by the tobacco material is greater than ambient (i.e., atmospheric) pressure and in some embodiments can be generated by conducting the heating process in a closed reaction vessel. The tobacco material normally is subjected to such treatment under conditions sufficient that the entire tobacco material is exposed to a temperature above about 100° C. for at least about 10 minutes. Normally, the tobacco material is treated in a high pressure controlled enclosed environment such as in a Parr Bomb. The closed environment can be pressurized to a pressure of about 100 to 1000 psig, more preferably about 200 to 500 psig, with an inert gas such nitrogen or carbon dioxide, a hydrocarbon gas such as methane, ethane or butane, or a fluorocarbon gas, which can act as heat transfer medium.

The resulting material after treatment is a substantially dry solid material, and thus does not require any further steps of processing such as water removal. The resulting flavorful and aromatic compositions are useful as casing or top dressing components for tobacco laminae and cut filler, as well as for other smokable material. Alternatively, such flavorful and aromatic compositions are useful in those types of smoking articles described in U.S. Pat. Nos. 4,708,151 to Shelar; 4,714,082 to Banerjee et al.; 4,756,318 to Clearman et al.; and 4,793,365 to Sensabaugh; as well as European Patent Publication Nos. 212,234 and 277,519.

The flavorful and aromatic compositions are also useful as cigarette filter additives. For example, the flavorful and aromatic compositions can be incorporated into low density polyethylenes and formed into strands, and then incorporated into cigarette filters as described in U.S. Pat. Nos. 4,281,671 to Byrne et al. and 4,862,905 to Green, Jr. et al. The flavorful and aromatic compositions are also useful as cigarette wrapper additives; or as additives to the inner regions of cigarette packages (e.g. within a paper/foil laminate of a cigarette package or within a low density polyethylene film which is placed within a cigarette package) in order to provide a desirable cigarette aroma and "pack aroma."

BRIEF DESCRIPTION OF THE DRAWINGS

In the drawings which constitute a portion of the original disclosure of the invention.

DETAILED DESCRIPTION OF THE INVENTION

Figure 1:
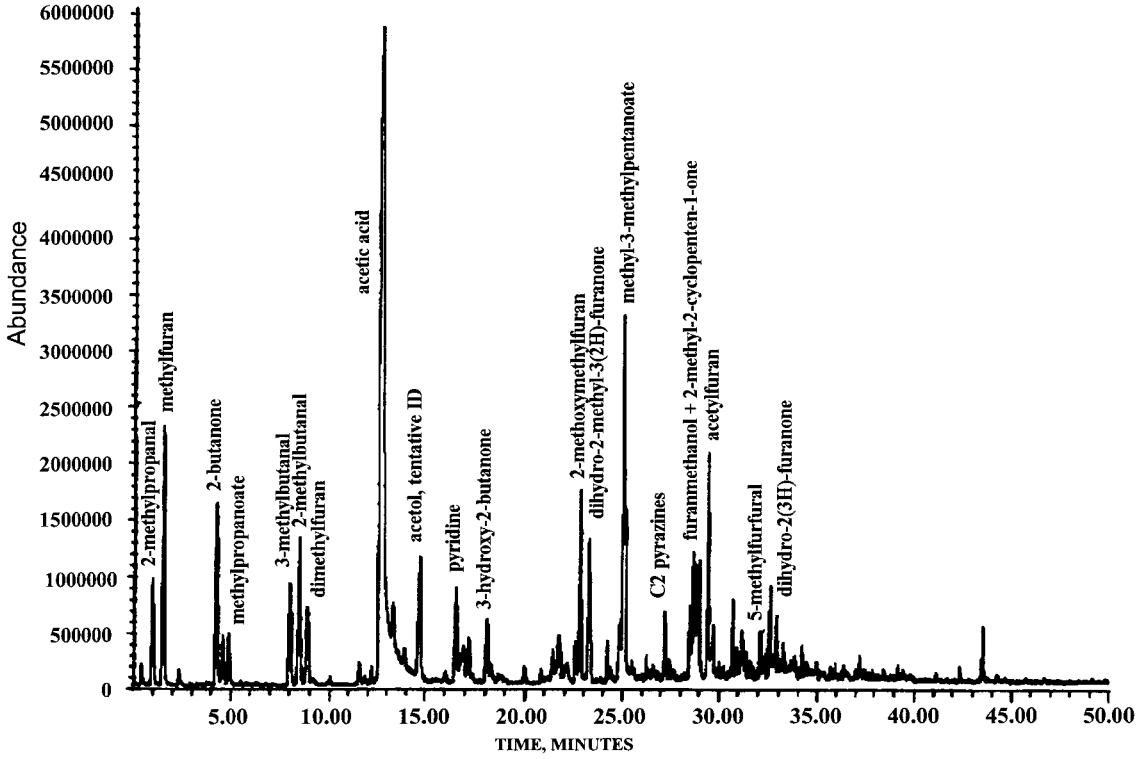
FIGS. 1–3 are total ion chromograms of head space volatiles of 0.2 gram samples of tobacco flavorant materials produced by treating tobacco dust, which normally would have been discarded as waste, in accordance with one preferred process of the present invention. The major components are identified and evidence thermal degradation of sugars and sugar amine chemistries generally known as the Maillard Reactions.

The present invention generally relates to a process for producing flavorful and/or aromatic substances from tobacco material comprising subjecting the tobacco material in a substantially dry state directly to heat treatment in a pressure controlled environment (e.g., a Parr bomb) under conditions sufficient to alter the organoleptic characteristics (e.g., the flavor and aroma characteristics) of the tobacco material.

The tobacco materials useful herein can be in various forms such as a dust or powder, cut filler, shreds, strips, stems, or leaves. Cigarette manufacturing side-products such as cigarette dust (C-dust), scraps and stalks are preferred as their use provides substantial cost saving. The tobacco material can also be grounded to form finely divided particles. Preferably, the tobacco material is in finely particulate form; however, grinding before the heat treatment process is not required. The tobacco material can be ground after the heating process of the invention as necessary or desirable for its intended use. Examples of suitable tobaccos include Burley, Flue-Cured, Turkish, Latakia, Maryland Cigar, as well as the rare or specialty tobaccos, or blends thereof. Unaged, uncured, mature or immature tobaccos may also be employed. Preferably at least a portion of the starting tobacco material is a Burley tobacco. The various types of tobacco and tobacco materials can be processed separately, or as blends thereof.

If desired, the tobacco material may be subjected to various treatments to reduce its size, such as grinding, such that the resulting tobacco material is in finely ground or powder form. Various grinding techniques will be apparent to one skilled in the art, and may include the use of e.g., ball mills or hammer mills. The grinding may also be carried out under vibrating or agitating conditions, the selection of said conditions being within the skill of one in the art.

The starting tobacco material should be substantially free of liquid, i.e., in a substantially dry form. However, the tobacco material typically contains minor amounts of moisture as are typical in tobacco processing. In some cases, additional liquids such as buffers, solvents, or solutions containing the additives described below can be present. In any event, the liquid content should be less than about 20% of the total weight. Preferably, the liquid content of the tobacco is less than about 15% by weight, more preferably less than about 10% by weight.

Additives can be added to the tobacco material prior to heat treatment. Examples of such additives include, but not limited to, amino acid, amino acid analog or amino acid source (e.g., glutamine, asparagine, proline, alanine, cystine, aspartic acid, phenylalanine, glutamic acid), one or more sugars or sugar sources (e.g., fructose, sucrose, glucose, maltose), and the like. If desired, flavoring agents (e.g., cocoa, licorice, St. John's bread, spices, herbs, and the like) can also be added to the tobacco material.

The tobacco material is subjected to moderately high temperature treatment such as described in U.S. Pat. No. 5,060,669 to White et al., the disclosure of which is incorporated herein by reference in its entirety. Typically, such treatment involves exposing the tobacco material to a temperature above about 100° C., preferably above about 110° C., and more preferably above about 120° C. However, it is desirable to maintain the temperature of the tobacco material to a temperature below about 250° C., more desirably below about 200° C., and most preferably at a temperature of about 175° C., in order to avoid an undesirable formation of components which are deleterious to the taste characteristics of the tobacco composition.

The moderately high temperature treatment of the tobacco material can advantageously be performed under an inert atmosphere. The term "inert atmosphere" is used herein to mean an atmosphere that is inert, i.e., non-reactive, with respect to the tobacco, under the particular treating conditions. For example, nitrogen, argon, or carbon dioxide gas can be employed in order to provide an inert atmosphere. Alternatively, a hydrocarbon gas such as methane, ethane or butane, or a fluorocarbon gas, can also provide an atmosphere which is inert with respect to the tobacco under the heat treating conditions. Preferred inert gasses are those gasses having a high heat capacity and can accordingly function as a heat transfer medium. However, the heat treatment can alternatively be conducted employing ambient atmospheric gases (i.e., air) as well.

The moderately high temperature treatment is performed in a pressure controlled environment. Such an environment is provided by enclosing the tobacco material in a hermetically sealed reaction vessel or chamber. Typically, a pressure controlled environment is provided using a pressure vessel or chamber which is capable of withstanding relatively high pressures. Such vessels or chambers (i) provide enclosure or containment of the tobacco material so that volatile flavor components of the tobacco material are not lost or do not otherwise escape during the moderately high temperature treatment step, and (ii) provide for treatment of the tobacco material at a temperature significantly above about 100° C. Preferred pressure vessels are equipped with an external heating source. Examples of vessels which provide a pressure controlled environment include a high pressure autoclave from Berghof/America Inc. of Concord, Calif., and Parr Reactor Model Nos. 4522 and 4552 available from The Parr Instrument Co. and described in U.S. Pat. No. 4,882,128 to Hukvari et al. Operation of such exemplary vessels will be apparent to the skilled artisan.

The closed environment can be pressurized to a pressure of about 100 to 1000 psig, more preferably about 200 to 500 psig, with inert or atmospheric gases as discussed above. Typical pressures experienced by the tobacco material during the heat treatment process of the present invention in such vessels range from about 300 psig to about 700 psig, but can be less than, or greater than, pressures of this range, as will be apparent.

The amount of time that the tobacco material is subjected to the moderately high temperature treatment can be varied depending on factors such as the particular heat treating temperature, the heat transfer capacity of the gases in the vessel, and the particular type and form of tobacco subjected to heat treatment. Normally, the time period is sufficient to heat the entire tobacco material at the desired temperature for a period of at least about 10 minutes, preferably at least about 20 minutes. Normally, the time period is less than about 3 hours, preferably between about one-half and one and one-half hours. In general it is desirable to control the time/temperature profile of the heat treatment of the tobacco materials to achieve significant conversion of sugars and sugar amine chemistries of tobacco components to Maillard Reaction products, while avoiding excessive heat treatment sufficient to generate significant quantities of materials exhibiting a burnt or tarry aroma and/or taste. In a preferred embodiment the tobacco is treated at 175° C. for about one hour. It is highly desirable to employ a high pressure inert gas as a heat transfer medium within the enclosed environment so that the tobacco material experiences a relatively uniform temperature throughout the treatment period. In particular, it is highly desirable for the entire tobacco material to be heated uniformly throughout as much as possible at the maximum temperature to which the tobacco material is subjected.

Conditions provided during the process of the present invention most desirably are such that certain components of the tobacco material (e.g., free amino acid pools and naturally occurring sugars) undergo the Maillard Reactions. The Maillard Reactions or "browning reactions" are reactions between (i) the amino substituents of amino acids, peptides, proteins or other nitrogen-containing compounds, and (ii) the carbonyl group of a sugar in the reducing form or other carboxyl-containing compounds which are indigenous or added to the tobacco material. Such reactions result in a significant darkening of the tobacco material, typically to an extremely dark brown color. See, Maillard, *Ana. Chim.*, Vol. 9, pp. 5 and 258(1916); Hodge, *J. Agric. Food Chem.*, Vol. 1, p. 928(1953); Nursten, *Food Chem.*, Vol. 6, p. 263(1981) and Waller et al, *ACS Symp. Ser.* (1983).

After the heat treatment under desired conditions, the enclosed environment is cooled down to a temperature at or near ambient temperature e.g., 40° C. or less, preferrably 30° C. or less, and the pressure is vented. Normally, the treated tobacco material is substantially dry and storage stable. If desired, the treated tobacco material can be employed immediately for use in preparing smoking materials as described. In some cases, grinding of the resultant material may be desirable or necessary after the process depending on the needs in its subsequent uses described below.

The treated tobacco material is useful in various smoking article manufacturing processes. It can be added to conventional tobacco cut filler or other smoking article materials in dry form, or as a liquid suspension, as a top dressing, or casing, or in any convenient mode selected by the manufacturer. In those cases in which the material is suspended in liquid, it can be desirable to grind the material prior to use. The amount of the treated tobacco material employed per cigarette or smoking article can vary. For example, in a typical cigarette having about 0.6 to about 1 g of cut filler per rod of smoking material, about 10 to about 100 ppm of the compound can advantageously be used as a top dressing or casing.

Moreover, the treated tobacco material may be used as a filter flavor material for a cigarette. The starting tobacco material may be used to provide flavor/aroma to any of the forms of material that are used in the manufacture of tobacco products such as cigars, cigarettes, smoking tobacco or snuffs.

The present invention is more fully illustrated by the following examples, which are set forth to illustrate the present invention and are not to be construed as limiting thereof. In the following examples, mg means milligram, $\mu$g means micrograms, g means grams, L means liters, mL means milliliters, min means minutes, and mm means millimeters.

EXAMPLE 1

Tobacco powders (c-dust) having a moisture content of approximately 10% by weight, or less, were each placed in a Parr Bomb. The bomb was sealed and was then charged with nitrogen at a pressure of 300 psig to improve the transfer of heat from a heat jacket in the bomb wall to the tobacco powder in the interior of the vessel. The pressurized tobacco material was then heated to a temperature of 175° C. and held at that temperature for one hour. After a rapid cooling to ambient temperature, the remaining pressure was vented, and the bomb was opened. An extremely powerful aroma having chocolated/cocoa notes was observed.

A sample of the headspace was collected from each of the resulting products and analyzed by dynamic headspace Purge and Trap/Gas Chromatography/Mass Selective Detection/Flame Ionization Detection (P&T/GC/MSD/FID) analyses using a conventional Headspace Unit, TEKMAR (Cincinnati, Ohio, USA) LSC 2000 equipped with a TEKMAR 2016 heated sampling station. The headspace sample was obtained and collected over a period of 20 minutes at a temperature of 70° C. from a 0.2 g sample held in a 25 ml sample tube that was swept with dry helium at a flow rate of 40 ml/min and a pressure of 20 psig throughout the sampling period. Then the headspace sample was analyzed by Gas Chromatography/Mass Selective Detection/Flame Ionization Detection as noted above.

Figure 2:
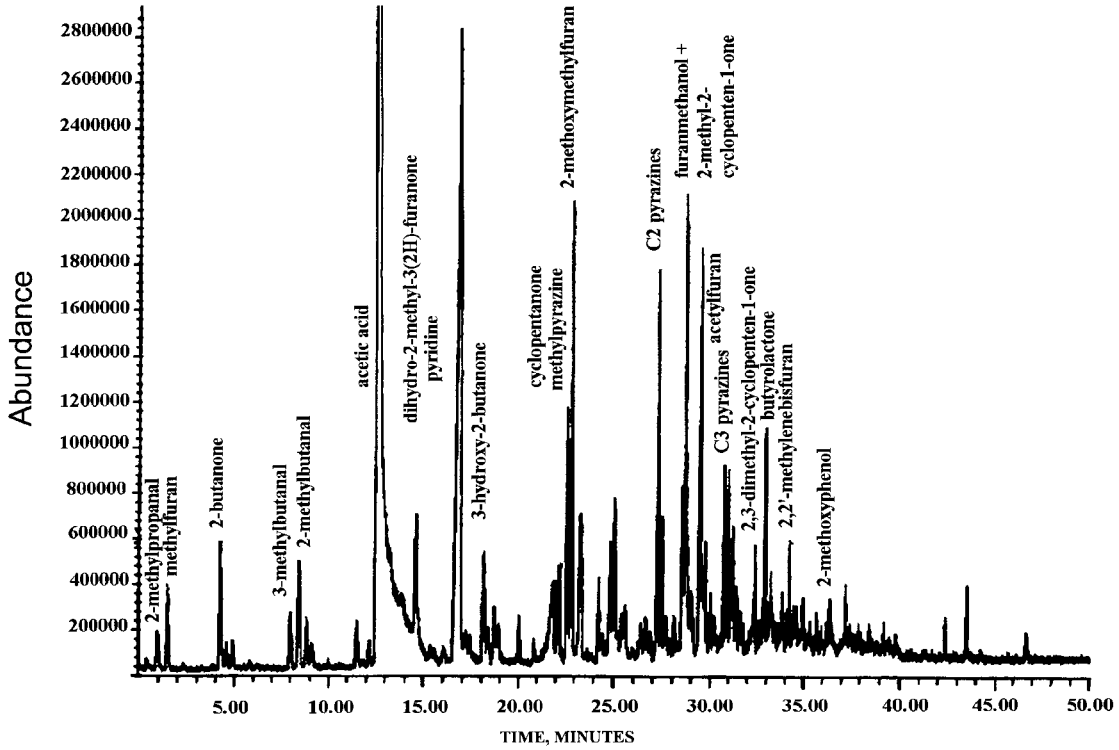
Figure 3:
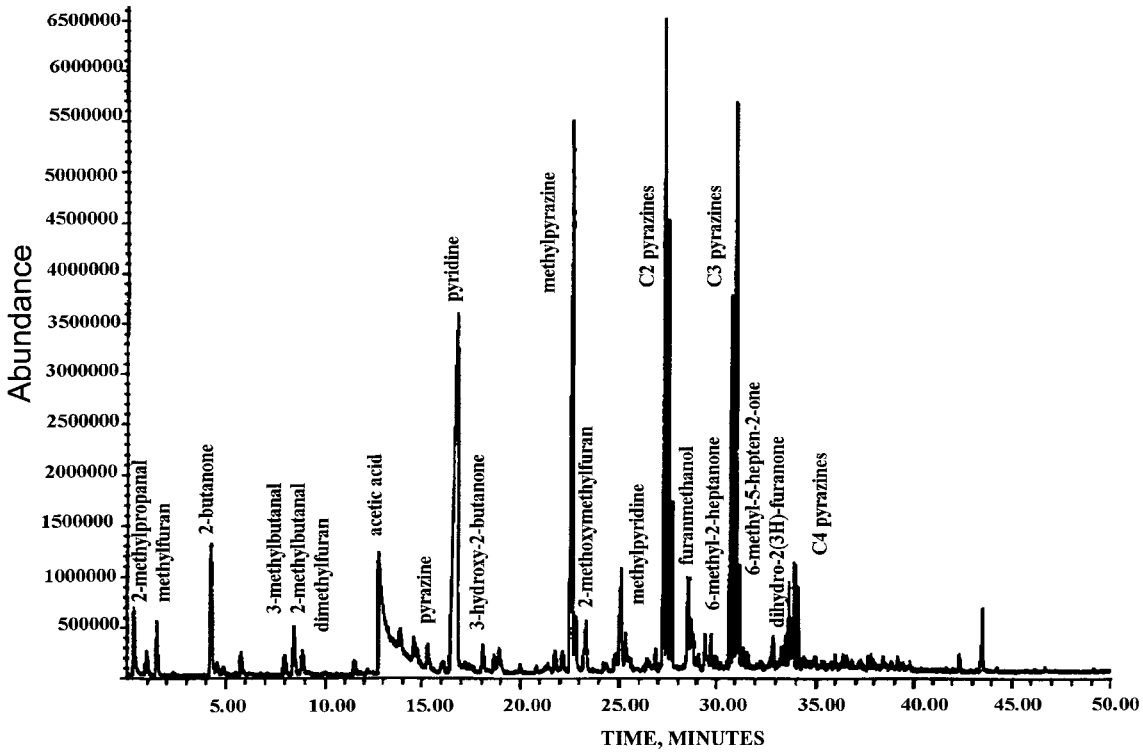

FIGS. 1–3 present the profiles of the head space volatiles from Turkish, Flue-Cured, and Burley tobacco powders treated according to the above procedures. Compound identifications are set forth in FIGS. 1–3 for the major volatile components in each sample. It will seen that the profile of the head space volatiles was a function of the tobacco type. The profiles of the head space above the Flue-Cured and Turkish heat treated tobacco was dominated by the presence of large amounts of acetic acid while the head space above the Burley heat treated tobacco was dominated by low molecular weight pyrazines. The presence of these low molecular weight pyrazines is consistent with sugar/nitrogen chemistries previously observed in tobaccos that are heat treated by conventional heat treating processes. In addition, the presence of furan derivatives, particularly apparent in the cases of the Flue-Cured and Turkish heat treated tobacco materials, confirm the presence of thermal degradation reactions during the processing. The "Abundance Valves" shown in the Figures were obtained using flame ionization detection (FID).

For purposes of comparison, a 3.5 gram sample of conventionally heat treated Burley tobacco was also subjected to dynamic heat space analysis in the same manner as set forth above except that the head space gas was collected from a 3.5 gram sample of the conventionally heat treated Burley tobacco. The conventional heat treating process involved subjecting the Burley tobacco to conditions of heat for a time and at a temperature comparable to the procedures used to prepare the heat treated tobacco materials of the invention; however, that the conventionally treated Burley tobacco was heat treated in an open oven.

Figure 4:
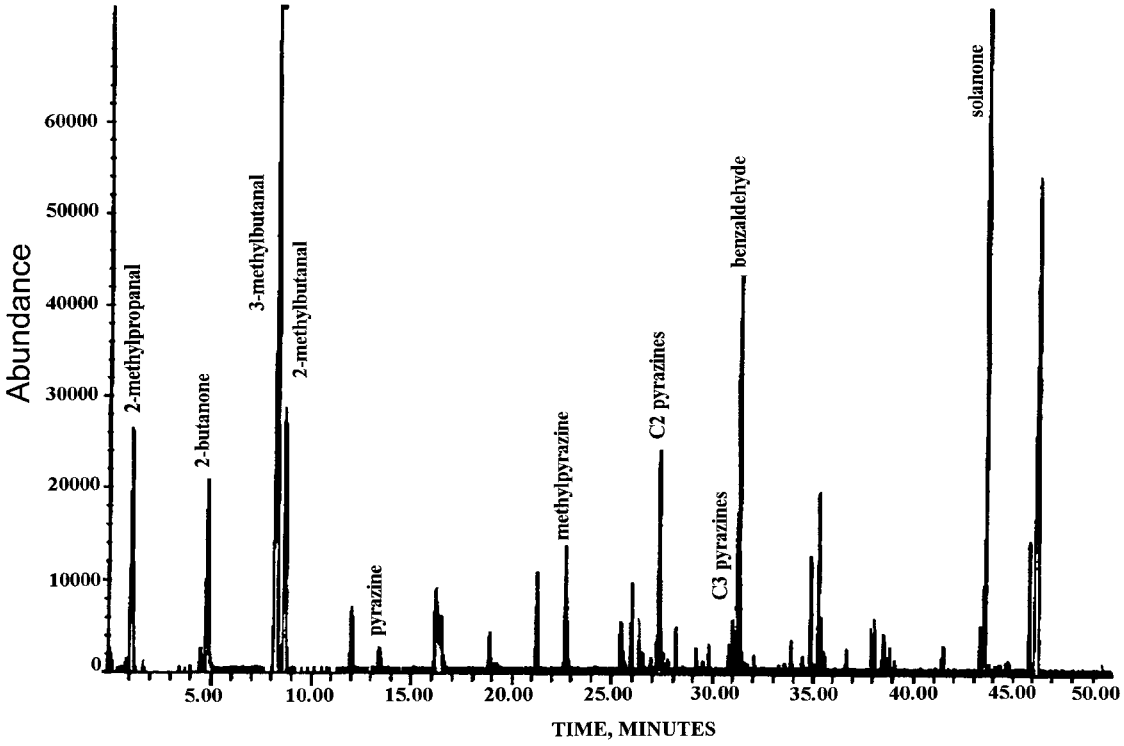
FIG. 4 illustrates for purposes of comparison, a total ion chromogram of head space volatiles of a 3.5 gram sample of conventionally heat treated Burley tobacco.

A comparison of total FID counts between the headspace samples of the heat treated tobacco products according to the present invention as shown in FIGS. 1–3, and the conventionally heat treated Burley tobacco, shown in FIG. 4, revealed that the average FID area counts for 0.2 g of the heat treated tobacco products of the invention was approximately 30,000 while that for the 3.5 g of conventionally heat treated Burley tobacco was approximately 15,000. Thus, although the sample of the conventionally heat treated Burley tobacco had a weight more than 17 times the weight of the samples of the tobacco materials of the invention, (3.5 g versus 0.2 g), the average total volatiles in the heat treated tobacco flavoring materials of the invention was double the total volatile material detected in the conventionally heat treated Burley tobacco. Accordingly, the amount of head space volatile content (and thus the flavor and aroma content) of heat treated tobacco, is increased by one to many orders of magnitude by employing the heat treating process according to the present invention as compared to conventional heat treating processes.

In the specification and examples, there have been disclosed preferred embodiments of the invention. Although specific terms are employed in these examples, they are used in a generic and descriptive sense only and not for the purpose of limitation, the scope of the invention being defined by the following claims.

That which is claimed:

1. A process for producing a tobacco flavoring component comprising subjecting tobacco material in substantially dry form to heat treatment in a closed elevated pressure environment at a temperature above 100° C. for a time sufficient to alter the organoleptic characteristics of the tobacco material, cooling the heat treated tobacco material to a temperature at or near ambient temperature while maintaining the tobacco material in said closed environment, and thereafter recovering the heat treated tobacco from said closed environment.

2. The process according to claim 1, wherein the tobacco material is tobacco dust.

3. The process according to claim 1, wherein the pressure controlled environment is a closed reaction vessel.

4. The process according to claim 1, wherein said pressure controlled environment contains a high pressure inert gas capable of improving the transfer of heat to the tobacco material.

5. The process according to claim 1, wherein the tobacco material is subjected to heat treatment at a temperature below about 250° C.

6. The process according to claim 1, wherein the tobacco material is subjected to heat treatment at a pressure of between about 100 psig and about 1000 psig.

7. The process according to claim 1, wherein the tobacco material is subjected to heat treatment at a pressure of between about 200 psig and about 700 psig.

8. The process according to claim 1, whereby the tobacco material is subjected to heat treatment at a pressure exceeding 100 psig in the presence of an inert gas.

9. A process for producing a natural tobacco flavoring component comprising the steps of:

(a) providing a finely particulate tobacco material having a moisture content of about 10% by weight or less;

(b) subjecting the tobacco material to heat treatment in a closed elevated pressure environment at a temperature above 100° C. for a time sufficient to generate Maillard Reaction products in said tobacco material; and (c) cooling the heat treated tobacco material to a temperature of about 30° C. or less while maintaining the tobacco material in said closed environment.

10. The process according to claim 9, wherein the tobacco material is tobacco dust.

11. The process according to claim 9, wherein the closed pressure environment is a closed reaction vessel.

12. The process according to claim 9, wherein said pressure controlled environment consists essentially of high pressure nitrogen gas.

13. The process according to claim 9, wherein the heat treatment of the tobacco material in the closed elevated pressure environment is conducted below about 200° C.

14. The process according to claim 9, wherein the tobacco material is subjected to heat treatment at a pressure of from about 100 psig to about 1000 psig.

15. The process according to claim 1, wherein the tobacco material is subjected to heat treatment at a pressure of from about 200 psig to about 700 psig.

16. The process according to claim 1, whereby the tobacco material is subjected to heat treatment in the presence of an inert gas at a pressure exceeding 100 psig.

17. A tobacco flavoring material comprising a heat treated tobacco material having a high content of Maillard Reaction product flavor and aroma componets, said heat treated tobacco material having been heat treated in a substantially dry state in a closed elevated pressure environment at a temperature above about 100° C.

18. The tobacco flavoring material of claim 17 wherein the tobacco material having been heat treated in a substantially dry state in said closed elevated pressure environment consists essentially of tobacco dust.

19. The tobacco flavoring material of claim 17, said heat treatment having been conducted at a temperature below about 250° C.

20. The tobacco flavoring material of claim 19, said heat treatment having been conducted at a pressure of between about 100 psig and about 1000 psig.

21. The tobacco flavoring material of claim 19, said heat treatment having been conducted at a pressure of between about 200 psig and about 700 psig.

* * * * *